US007415220B2

(12) United States Patent
Harpur et al.

(10) Patent No.: US 7,415,220 B2
(45) Date of Patent: Aug. 19, 2008

(54) LOCAL SUPPRESSION OF UNWANTED TONER EMISSIONS

(75) Inventors: Ian Gerard Harpur, Welwyn Garden City (GB); Ian Geoffrey Harper, Riseley (GB)

(73) Assignee: Xerox Corporation, Norwalk, CT (US)

( * ) Notice: Subject to any disclaimer, the term of this patent is extended or adjusted under 35 U.S.C. 154(b) by 255 days.

(21) Appl. No.: 11/430,430

(22) Filed: May 9, 2006

(65) Prior Publication Data

US 2007/0264041 A1 Nov. 15, 2007

(51) Int. Cl.
*G03G 15/08* (2006.01)

(52) U.S. Cl. ..... 399/104; 399/279; 399/282

(58) Field of Classification Search ..... 399/104, 399/265, 267, 272, 276, 277, 279, 281, 282, 399/286; 492/8
See application file for complete search history.

(56) References Cited

U.S. PATENT DOCUMENTS 5,177,536 A 1/1993 Watanabe et al.
5,287,148 A 2/1994 Sakemi et al.
6,782,225 B2 * 8/2004 Kai et al. ..... 399/223
6,898,406 B2 * 5/2005 Suzuki et al. ..... 399/277
6,978,109 B2 * 12/2005 Shoji et al. ..... 399/274
7,116,932 B2 * 10/2006 Takeuchi et al. ..... 399/274
7,127,199 B2 * 10/2006 Imamura et al. ..... 399/277

* cited by examiner

*Primary Examiner*—Hoan H Tran
(74) *Attorney, Agent, or Firm*—Fay Sharpe LLP

(57) ABSTRACT

A developer apparatus for a printing device includes a rotatable developer carrying member which carries developer thereon. A magnet assembly is disposed in the developer carrying member. The magnet assembly includes a plurality of magnets for conveying the developer. The magnets generate a magnetic field over a larger proportion of a circumference of the developer carrying member in an edge region adjacent an end of the developer carrying member than in a mid-region longitudinally spaced from the end of the member by the edge region. The apparatus enables unwanted toner emissions to be reduced by the development of a stable annular magnetic brush in the edge regions.

21 Claims, 6 Drawing Sheets

LOCAL SUPPRESSION OF UNWANTED TONER EMISSIONS

BACKGROUND

The exemplary embodiment relates to printing systems. It relates particularly to a magnetic brush roll and method for suppressing unwanted toner emissions from a developer unit and will be described with reference thereto.

In typical electrophotographic image forming devices, such as copy machines and laser beam printers, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a developer material. Generally, the developer material comprises toner particles adhering triboelectrically to carrier granules. The developed image is subsequently transferred to the print medium, such as a sheet of paper. The fusing of the toner image onto paper is generally accomplished by applying heat to the toner with a heated roller and application of pressure. In multi-color printing, successive latent images corresponding to different colors are recorded on the photoconductive surface and developed with toner of a complementary color. The single color toner images are successively transferred to the copy paper to create a multi-layered toner image on the paper. The multi-layered toner image is permanently affixed to the copy paper in the fusing process.

The toner is stored in a developer unit and delivered from the unit onto the photoreceptor by a magnetic brush system. The brush rotates and is replenished with toner and carrier granules as it reenters the developer unit. There is a tendency for toner particles to be emitted from the magnetic brush system or from the developer housing into the surrounding atmosphere. Toner emissions from a xerographic magnetic brush system can contaminate the developer and reduce the reliability of other components of the image forming device.

The toner emissions may coat surfaces which are sensitive to such contamination, causing them to malfunction. One such surface is the scorotron grid, where, for example, if too much toner contamination alights, an overvoltage condition on the charged photoreceptor occurs. This, in turn, can give rise to image quality problems or induce a sudden and uncontrolled loss of developer material into the marking engine cavity, which may necessitate a service call. Even if the level of contamination does not cause a reliability issue, for example if it alights on a handle or door visible to the customer, it can present an impression of a poorly operating machine.

Unwanted or uncontrolled toner emissions from within the developer housing can often be inhibited by implementation of various sealing solutions. Emissions from the brush itself have proved more difficult to control. In particular, toner may escape at the edges of the magnetic brush into the atmosphere.

INCORPORATION BY REFERENCE

The following references, the disclosures of which are incorporated herein in their entireties by reference, are mentioned.

U.S. Pat. No. 5,287,148, which issued Feb. 15, 1994, entitled MAGNETIC SEAL FOR A DEVELOPING APPARATUS, by to Sakemi, et al., discloses a developing apparatus comprising a magnetic brush.

U.S. Pat. No. 5,177,536, which issued Jan. 5, 1993, entitled DEVELOPING APPARATUS HAVING A MAGNETIC SEAL, by Watanabe, et al., discloses a developing apparatus in which a magnetic member is disposed close to the circumferential surface of a developer carrying member which is magnetized by the magnet of the developer carrying member.

BRIEF DESCRIPTION

According to aspects illustrated herein, there is provided a magnetic brush roll including a rotatable developer carrying member. A magnet assembly is disposed in the developer carrying member for conveying developer on the developer carrying member. The magnet assembly has a magnet cross-section which varies between first and second longitudinally spaced edge regions of the developer carrying member and a mid-region of the developer carrying member. The mid-region is intermediate the edge regions. In operation, a magnetic brush including developer is maintained over a larger proportion of a circumference of the developer carrying member in the edge regions than in the mid-region.

In other aspects, a developer apparatus is provided which includes a housing for accommodating a developer containing toner particles. A rotatable developer carrying member is disposed at least partly in the housing for facing an associated charge retentive member at a developing position and for carrying the developer thereon to the developing position. A magnet assembly is disposed in the developer carrying member. The magnet assembly includes a plurality of magnets for conveying the developer. The magnets generate a magnetic field over a larger proportion of a circumference of the developer carrying member in an edge region adjacent an end of the developer carrying member than in a mid-region longitudinally spaced from the end of the member by the edge region.

In other aspects, a method includes generating a magnetic field on a rotating developer carrying member which differs between a mid-region and an edge region of the developer carrying member and transporting developer material comprising toner particles on the mid-region of the rotating developer carrying member to a developing position facing an associated charge retentive member. The magnetic field releases developer material from the mid-region, which has been depleted of toner particles by the associated charge retentive member, into a housing. The magnetic field maintains developer material on the edge region of the developer carrying member to form a barrier which inhibits toner emissions from the mid-region into the atmosphere exterior to the housing.

DETAILED DESCRIPTION

Figure 1:
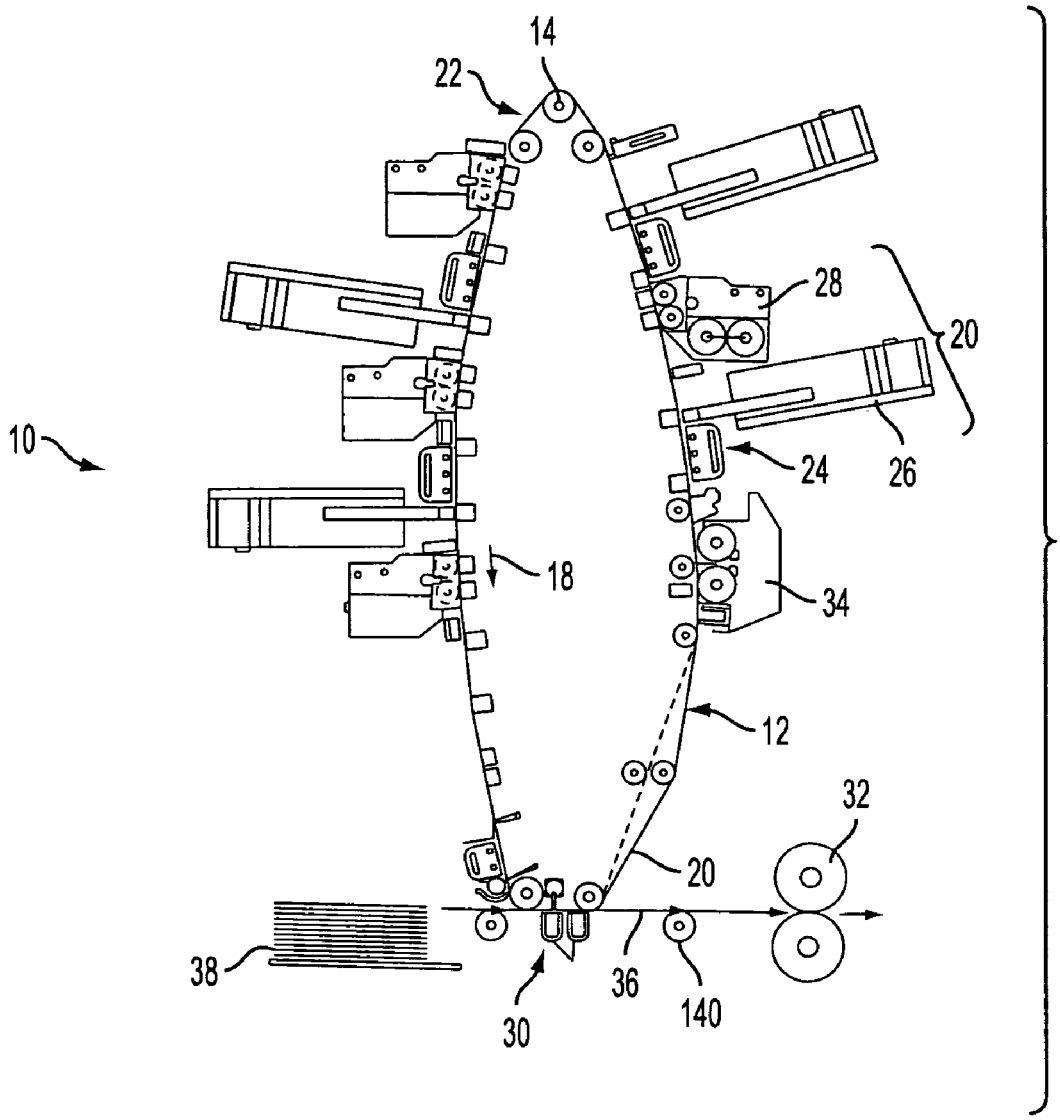
FIG. 1 is a schematic view of an imaging system including a plurality of developer units in accordance with one aspect of the exemplary embodiment.

Aspects of the exemplary embodiment disclosed herein relate to a magnetic brush roll for a developer unit, a xerographic printing device which incorporates the developer unit, and to a method of printing. The disclosed magnetic brush roll suppresses (i.e., inhibits or prevents) unwanted emissions of toner from locally defined, selected areas of the magnetic brush both airborne and electrostatically developed. In various aspects, toner emissions emanating from the extremes of the process width are reduced.

In various aspects, the method may include suppressing toner emissions from a magnetic brush which is formed of magnetically attracted developer material on the brush roll. In one aspect, a method of printing includes locally preventing replenishment of toner lost from a magnetic brush whilst enabling the image areas of the magnetic brush to be completely replenished.

In various aspects, the exemplary magnetic brush creates a toner concentration which decreases toward one or both of the edges of the magnetic brush roll (i.e., the extremes of the process direction), which generally lie outside the image area of the magnetic brush roll. To reduce the toner concentration at the edges, the magnetic brush roll includes a magnet assembly. The assembly is modified adjacent the ends of the brush roll to provide a magnetic field over a larger proportion of the brush roll circumference than in a mid-region, which encompasses the image area of the brush roll. The magnetic field in these edge regions may be generated over a full 360 degrees of the roll, or substantially over 360°. The magnet assembly effectively prevents the release of the developer from the magnetic brush.

In accordance with various aspects, locally controlling the toner concentration on selected regions of the magnetic brush roll creates an edge region adjacent one or both of the ends of the brush roll from which development type toner emission is greatly reduced or even eliminated. The density of the magnetic brush in these regions may be maintained by increasing the relative concentration of carrier material. Away from the edge region(s) the toner concentration may be unaffected. The toner-depleted brush can now act as a dynamic high impedance seal which prevents migration and emissions of airborne toner or other contaminants into the general airspace of the marking engine.

The exemplary magnetic brush roll provides a highly effective toner delivery system whilst effectively minimizing the ability of that system to deliver toner in unwanted places.

As with a conventional magnetic brush roll development system, one function of the exemplary magnetic brush roll is to load and unload a carefully controlled magnetic brush so that it is continuously replenished with dual component developer material (a mixture of carrier granules and magnetic toner particles). To produce good quality images, the developer material is generally maintained at an optimum toner concentration and "condition." Depending on the development system, the condition may be a function of the tribocharge, conductivity or some other parameter(s) relevant to developability. As the magnetic brush roll rotates, the magnetic brush becomes depleted with respect to toner particles, when the toner is lost to the photoconductive member to form an image. The toner is then replenished, in the mid-region of the brush. In this region of the magnetic brush, the magnetic roll loading function is highly efficient and can maintain optimum developability. As will be appreciated, if full replenishment of toner is not achieved, development can be inhibited and image quality can suffer.

The exemplary system may take advantage of the fact that unwanted toner emissions tend to lessen in severity as the toner concentration in the magnetic brush drops. In various aspects, the exemplary method locally minimizes toner concentration at the brush edges whilst not affecting areas where toner concentration is to be maintained for image forming. This provides a solution to controlling toner emissions without causing a negative impact on the rest of the system.

With reference to FIG. 1, a printing device 10 is illustrated schematically. A "printing device," as used herein, can include any device for rendering an image on print media, such as a copier, laser printer, bookmaking machine, facsimile machine, or a multifunction machine.

"Print media" can be a usually flimsy physical sheet of paper, plastic, or other suitable physical print media substrate for images. An image generally may include information in electronic form which is to be rendered on the print media by the printing device and may include text, graphics, pictures, and the like. The operation of applying images to print media, for example, graphics, text, photographs, etc., is generally referred to herein as printing.

The xerographic printing device 10 includes many of the hardware elements employed in the creation of desired images by electrophotographical processes, including a charge retentive member 12, such as a rotating photoreceptor in the form of a belt or drum. The illustrated photoreceptor 12 comprises a photoconductive belt, which is supported by a plurality of rollers 14. The belt 12 advances in the direction of arrow 18 to move successive portions of the external surface of photoconductive belt into the proximity of one or more processing stations 20 (four in the illustrated embodiment) disposed at various points around the circumference of the photoreceptor, one processing station for each of the colors to be applied. The images are created on a surface 22 of the photoreceptor.

Each processing station 20 includes a charging station 24 for the respective color to be applied, such as a charging corotron, an exposure station 26, such as a raster output scanner (ROS) or a light emitting diode (LED) bar, which forms a latent image on the photoreceptor, and a developer apparatus or developer unit 28, associated with each charging station for developing the latent image formed on the surface of the photoreceptor, which includes the exemplary toner suppression system. The illustrated printing device also includes a transferring unit 30, such as a transfer corotron, a fuser 32, and a cleaning device 34. A printing device capable of printing in multiple colors may have multiple developer units, each developing the photoreceptor with a different primary-color toner. Paper or other print media is supplied to the marking engine along a paper path 36 from one or more media supply trays 38. The paper is drawn from the supply tray 38, typically one sheet at a time, by feed rollers 40.

In operation, the photoreceptor 12 rotates and is charged at the charging station 24. The charged surface arrives at the exposure station 26, where a latent image is formed on an image region of the photoreceptor. The portion of the photoreceptor on which the latent image is formed arrives at the developer unit 28, which applies toner particles to the latent image to obtain a toner image. The developed image moves with the photoreceptor to the transferring unit 30, which transfers the toner image thus formed to the surface of a print media substrate, such as a sheet of paper, by applying a potential to the sheet. The sheet and image are conveyed away from the photoreceptor to the fuser 32, which fuses the image to the sheet. The fuser 32 generally applies at least one of heat and pressure to the sheet to physically attach the toner and to provide a level of gloss to the printed media. Meanwhile, the photoreceptor 12 rotates to the cleaning device 34, which removes residual toner and charge from the photoreceptor, ready for beginning the process again. It is to be appreciated that the printing device can include an input/output interface, a memory, a marking cartridge platform, a marking driver, a function switch, a controller and a self-diagnostic unit, all of which can be interconnected by a data/control bus.

The developer unit 28 develops the electrostatic image by depositing toner particles of a selected color on the electrostatic latent image.

It will be appreciated that the printing device is not limited to the specific arrangement of subsystems illustrated. For example, in another exemplary printing device (not shown), each colorant is associated with its own photoreceptor and the image transferred between the photoreceptor and the print media by an intermediate transfer belt. In yet another embodiment, a single ROS and a single charging station are used and the print media is returned to the transfer corotron multiple times. In other embodiments, only one processing station may be used for monochrome printing.

Figure 2:
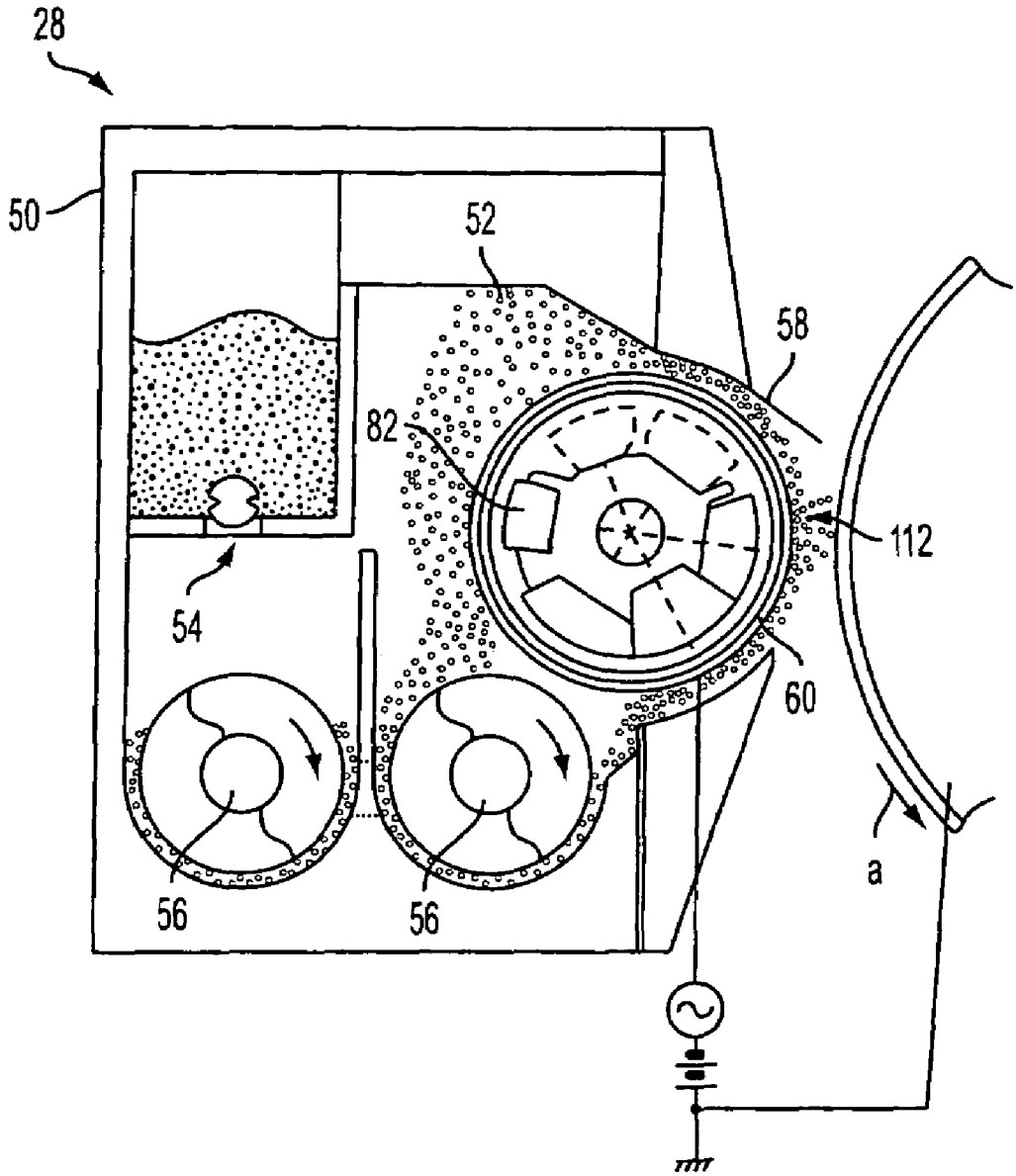
FIG. 2 is a cross sectional view of one of the developer units of FIG. 1, illustrating a magnetic brush roll.

With reference now to FIG. 2, which shows one of the developer units 28 of FIG. 1, the developer unit includes a housing or reservoir 50 which contains developer material 52. The developer material is a two component mixture of carrier granules and toner particles. The carrier granules may be formed of a magnetizable material. By way of example, the carrier granules of the developer material may include a ferromagnetic core having a thin layer of magnetite overcoated with a non-continuous layer of resinous material. The toner particles may be made from a resinous material, such as a vinyl polymer, mixed with a coloring material, such as chromogen black in the case of black toner. The developer material may comprise from about 95% to about 99% by weight of carrier and from 5% to about 1% by weight of toner.

The housing 50 is periodically replenished with fresh toner via a toner supply inlet 54. One or more agitators 56, such as an auger, within the housing 50 distribute the toner particles throughout the carrier material. The housing includes a longitudinal outlet 58, which extends in the cross-process direction through which toner is released onto the photoreceptor 12.

A magnetic brush roll 60 is mounted at least partially within the housing, e.g., adjacent the outlet 58 for transporting developer material from the reservoir 50 to the photoreceptor 12. In one embodiment, the toner may be transferred directly to the photoreceptor 12. In other embodiments, the magnetic brush roll may transfer the toner to loading nips of one or more donor rolls (not shown) intermediate the magnetic brush roll 60 and the photoreceptor 12.

Figure 3:
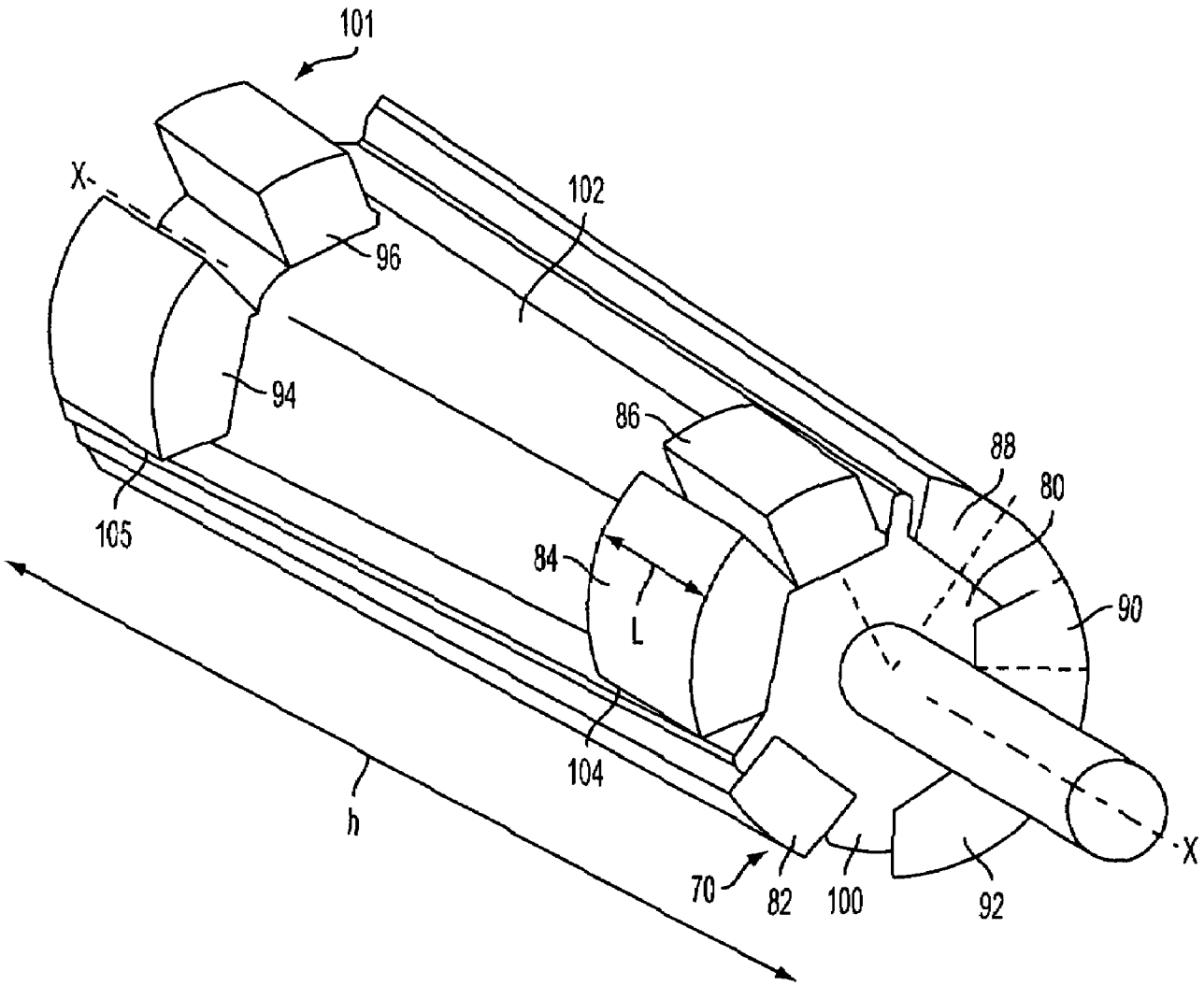
FIG. 3 is a perspective view of an interior of the magnetic brush roll of FIG. 2.
Figure 4:
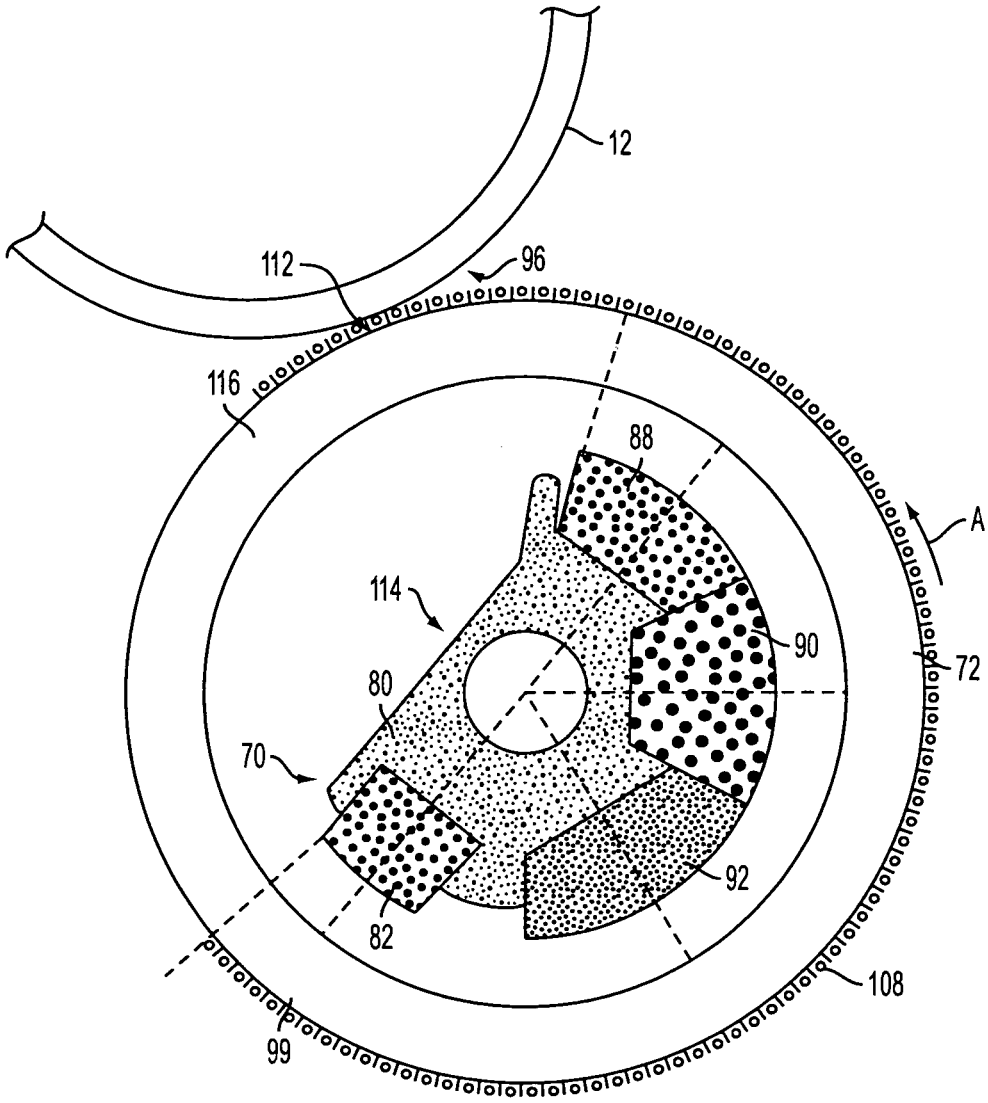
FIG. 4 is a cross sectional view of the magnetic brush roll of FIG. 2 through a mid-region illustrating a magnet assembly.
Figure 5:
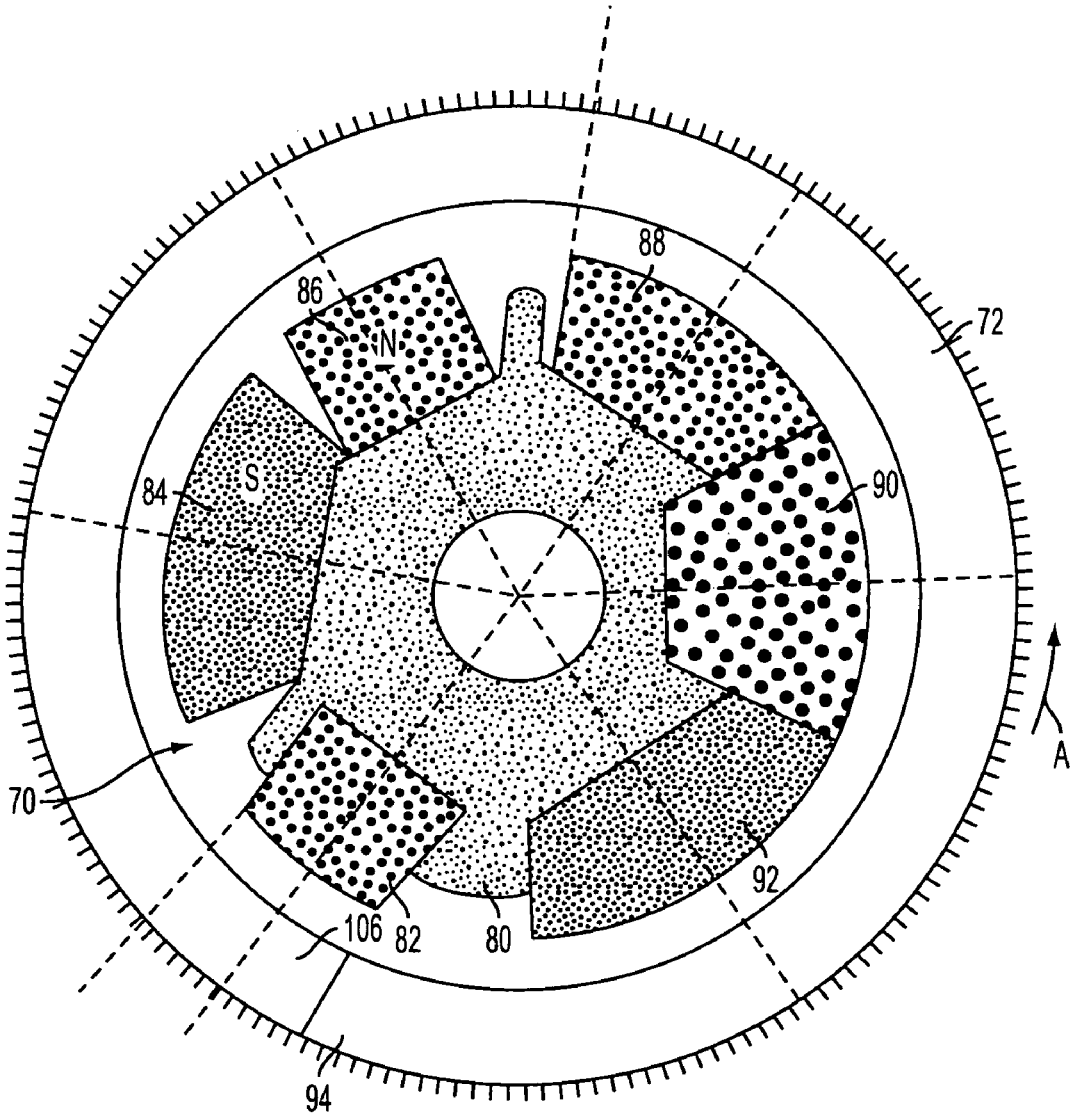
FIG. 5 is a cross sectional view of the magnetic brush roll of FIG. 2 through an edge region illustrating the increased coverage of the magnet assembly.

With reference now to FIGS. 3-5, the illustrated magnetic brush roll 60 includes an elongate magnet assembly 70 at its core, which is surrounded by a carrying member 72 in the form of a hollow sleeve. The sleeve 72 may be formed of non-magnetic material, such as aluminum or stainless steel. The sleeve 72 is rotatably supported and rotated, relative to the magnet assembly 70 by a driving device (not shown). In operation, the illustrated magnet assembly 70 thus remains stationary while the sleeve 72 rotates around it about a longitudinal axis X-X which passes through the magnet assembly. The axis X-X is generally perpendicular to the process direction 18. In the illustrated embodiment, the sleeve 72 rotates in a direction opposite to the photoreceptor 12, as illustrated by arrow A. However, it is also contemplated that the sleeve may rotate in the same direction as the photoreceptor.

Figure 6:
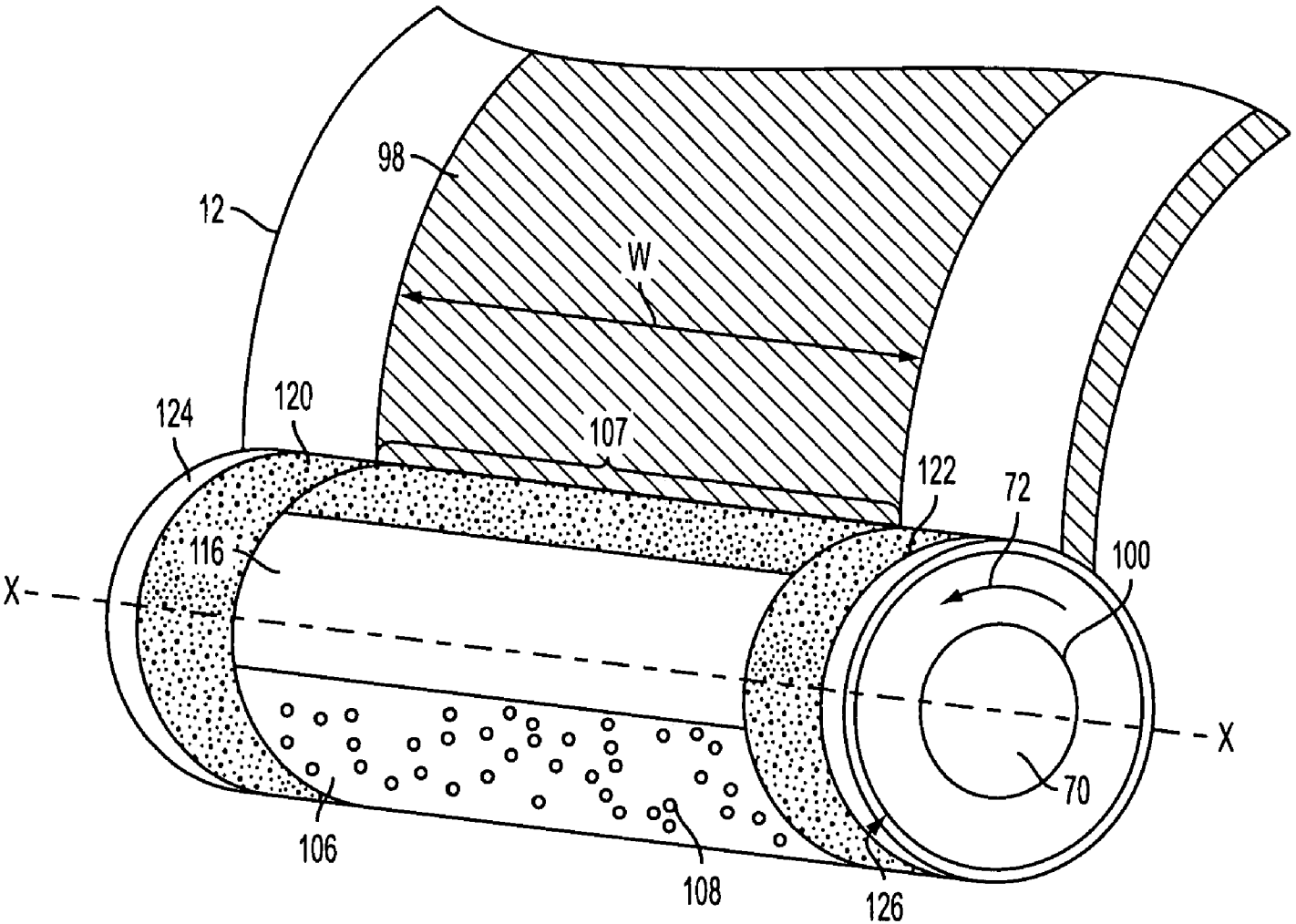
FIG. 6 is a perspective view of a sleeve of the magnetic brush roll of FIG. 2, showing a magnetic brush formed thereon.

The magnet assembly 70 includes an axially extending support 80 formed from aluminum or other non-magnetic material. Embedded in the support 80 are a plurality of magnets 82, 84, 86, 88, 90, 92, 94, 96 which all extend generally perpendicular to the direction of travel 18 of the photoreceptor. The magnets 82, 84, 86, 88, 90, 92, 94, 96 may be magnetic or electromagnetic. A first group of the magnets 82, 88, 90, 92 ("long magnets") each have a length h which generally exceeds a cross process width w of an image area 98 (i.e., the latent image carrying portion) of the photoreceptor on which the toner is to be deposited (FIG. 6). The long magnets 82, 88, 90, 92 are positioned such that they predominantly generate a magnetic field through an arcuate portion 99 of the sleeve 72 which is less than the full circumference of the sleeve. For example, as best shown in FIG. 4, four long magnets 82, 88, 90, 92 of alternating polarity are closely spaced on the side furthest from the photoreceptor 12. In the illustrated embodiment, the long magnets 82, 88, 90, 92 generate a magnetic field over less than about 270° of the circumference, e.g., about 210° in the image area.

As shown in FIGS. 3 and 5, the remaining magnets 84, 86, 94, 96 ("short magnets") extend less than the full length of the long magnets 82, 88, 90, 92 and are arcuately spaced therefrom around the support. Specifically, short magnets 84, 86 extend a distance I from adjacent one end 100 of the magnet assembly, with similar short magnets 94, 96 extending from adjacent the opposite end 101 of the magnet assembly, leaving a mid-region 102 of the magnet assembly free of short magnets. The short magnets 84, 86 and 94, 96 may thus be located only in first and second edge regions 104, 105 of the magnet assembly which lie outside the image region 98 of the photoreceptor. These edge regions are typically the longitudinal region from which, absent these extra magnets 84, 86, 94, 96 unwanted toner emissions would normally take place. In the edge regions, the long and short magnets 82, 84, 86, 88, 90, 92, 94, 96 create a magnetic field over a larger proportion of a circumference of the sleeve than in the mid-region 102. In general, the magnetic field is generated over substantially the full circumference of the sleeve in the edge regions. This substantially inhibits unwanted toner emissions into the atmosphere from these regions and blocks emission from the mid-region.

With reference also to FIG. 6, for illustration purposes, toner particles are illustrated as circles and carrier granules as rods, although it will be appreciated that the size and shape of these components may be substantially different from those illustrated. As the sleeve 72 rotates about its longitudinal axis X-X, an arcuate portion 106 of the circumference of the sleeve enters the developer housing 50 and picks up fresh toner and carrier granules under the magnetic field generated by a pickup magnet 82. As will be explained, the fresh toner and carrier are picked up primarily in a mid-region 107 of the sleeve, which is located radially outward of the corresponding mid-region 102 of the magnet assembly. The toner and carrier particles are attracted to the sleeve 72 and form a magnetic brush 108 on the surface of the sleeve When the sleeve 72 reaches a developing position 112 (FIG. 4), facing the photoreceptor 12, the toner is attracted from the magnetic brush 108 of the sleeve by a bias voltage onto the latent image (or is transferred thereto via the intermediate donor rolls). The sleeve 72 rotates along with the residual carrier depleted of toner, back towards the developer housing 50. As the sleeve 72 reaches a magnet-free portion 114 of the magnet assembly, the field strength rapidly diminishes and the depleted developer material in the mid-region 107 is released from the sleeve (illustrated by largely empty region 116 of the mid-region of the sleeve which moves as the sleeve rotates), and falls back into the developer housing 50, where it is replenished by mixing with the toner therein.

Annular edge regions 120, 122 of the sleeve 72 at either end of the mid-region 107, support portions of the magnetic brush 108 which comprise carrier granules that may be substantially depleted of toner particles. The magnetic brush in the two edge regions 120, 122 extends over substantially the entire circumference of the sleeve. In edge regions 120, 120, substantially no release of the material forming the magnetic brush occurs because the magnetic field strength is maintained around the full circumference. These regions 120, 122, which may be at or closely adjacent peripheral edges 124, 126 of the sleeve, act as a toner suppression system. The annular edge regions 120, 122 generally lie outside the image forming region 98 of the photoreceptor 12. This stable region of the magnetic brush, of generally lower toner concentration, suppresses the unwanted emission of toner particles into the atmosphere by creating a barrier to toner emission. For example, the magnetic brush maintained in the edge regions traps toner which is emitted from the mid-region 107 of the sleeve, preventing its escape into the atmosphere.

During start up of the developer unit, the edge regions 120 and 122 may pick up a mixture of toner and carrier granules in the normal way. Over an extended period of time, however, the toner to carrier ratio tends to decrease due to small amounts of the toner being drawn to the latent image or dispersed into the atmosphere. Thus, any emissions from these captured regions rapidly diminish, since any toner lost cannot be replenished by fresh material from the developer module. Thus, the capture of the developer prevents toner replenishment, as desired. Since the toner concentration becomes lower, even with high toner charge, the toner emission is reduced; the additional magnets at the ends prevent developer release into the cross-mixing sump.

Even when the toner ratio is substantially the same as in the mid-region of the magnetic brush roll, the lack of repeated discharge and pick-up of toner in this region contributes to reduced toner emissions.

It will be appreciated that the differences in the magnetic field between the edge regions of the sleeve and the mid-regions can be created with different arrangements of magnets than shown herein. For example, fewer or more magnets than illustrated may be employed. In the illustrated embodiment, as can be seen from a comparison of FIGS. 3 and 4, the magnet assembly has a cross section, perpendicular to the longitudinal axis, which varies from the edge regions to the mid region. This results in the observed magnetic field differences when the developer apparatus is operated. Other methods of generating a magnetic field strength distribution which varies between the ends and the mid-region are also contemplated. For example, any magnet assembly which creates a more uniform field in the edge regions than in the mid-region of the sleeve may be employed.

Tests performed using a magnetic brush roll formed as described herein, for a 10,000 print run show reduced toner emissions compared to a standard roll, as determined by visual observation. During this relatively short run, the toner concentration at the ends remained comparable to the central region.

The modified roll structure for toner emissions reduction finds application in a wide range magnetic brush subsystems. It is particularly useful in systems which use fine grained toner. Such toner particles have a higher tendency for emission than larger, heavier particles.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A magnetic brush roll comprising:

a rotatable developer carrying member;

a magnet assembly disposed in the developer carrying member for conveying developer on the developer carrying member, the magnet assembly having a magnet cross section which varies between first and second longitudinally spaced edge regions of the developer carrying member and a mid-region of the developer carrying member, the mid-region being intermediate the edge regions, such that in operation, a magnetic brush comprising the developer is maintained over a larger proportion of a circumference of the developer carrying member in the edge-regions than in the mid region.

2. The magnetic brush roll of claim 1, wherein the magnet assembly comprises more magnets in the edge regions than in the mid region.

3. The magnetic brush roll of claim 1, wherein in operation, the magnetic brush is substantially annular in the edge regions.

4. The magnetic brush roll of claim 1, wherein in operation, the developer carrying member rotates relative to the magnet assembly about a longitudinal axis.

5. The magnetic brush roll assembly of claim 1, wherein at least a first of the magnets extends longitudinally between the edge regions and the mid-region and a second of the magnets extends primarily in one of the edge regions.

6. The magnetic brush roll assembly of claim 5, wherein the at least a first magnet comprises a plurality of first magnets.

7. The magnetic brush roll assembly of claim 5, wherein the at least a second magnet comprises a plurality of second magnets.

8. The magnetic brush roll assembly of claim 1 comprising at least a first magnet having a first length and a second magnet having a second length shorter than the first length, the second magnet being disposed adjacent one of the edge regions of the rotatable developer carrying member.

9. A developer apparatus comprising the magnetic brush roll of claim 1 and further comprising:

a housing for accommodating a developer containing toner particles, the rotatable developer carrying member being disposed at least partly in the housing.

10. A printing device comprising the magnetic brush roll of claim 1 and a charge retentive member facing a developing position of the magnetic brush roll.

11. A method of printing comprising:

developing an image on a charge retentive member with the magnetic brush roll of claim 1.

12. A developer apparatus, comprising:

a housing for accommodating a developer containing toner particles;

a rotatable developer carrying member, disposed at least partly in the housing, for facing an associated charge retentive member at a developing position and for carrying the developer thereon to the developing position;

a magnet assembly disposed in the developer carrying member, the magnet assembly comprising a plurality of magnets for conveying the developer, the magnets generating a magnetic field over a larger proportion of a circumference of the developer carrying member in an edge region adjacent an end of the developer carrying member than in a mid-region longitudinally spaced from the end of the member by the edge region.

13. The developer apparatus of claim 12, wherein the magnet assembly comprises at least a first magnet which extends in the both the edge region and the mid-region and at least a second magnet which extends primarily in the edge region.

14. The developer apparatus of claim 13, wherein the at least a first magnet has a greater length than the at least a second magnet.

15. The developer apparatus of claim 13, wherein the at least a first magnet comprises a plurality of first magnets.

16. The developer apparatus of claim 13, wherein the at least a second magnet comprises a plurality of second magnets.

17. The developer apparatus of claim 12, wherein the magnet assembly includes a first group of magnets which generate a magnetic field such that depleted developer material falls from the mid-region of the developer carrying member into the housing and developer material in the edge region is retained on the developer carrying member.

18. The developer apparatus of claim 12, wherein the mid-region of the magnet assembly comprises fewer magnets than first and second edge regions of the magnet assembly.

19. A printing device comprising the developer apparatus of claim 12 and a charge retentive member.

20. A method of printing comprising:

developing an image on a charge retentive member with the developer apparatus of claim 12.

21. A method comprising:

generating a magnetic field on a rotating developer carrying member which differs between a mid-region and an edge region of the developer carrying member;

transporting developer material comprising toner particles on the mid-region of the rotating developer carrying member to a developing position facing an associated charge retentive member;

the magnetic field releasing developer material from the mid-region, which has been depleted of toner particles by the associated charge retentive member, into a housing; and the magnetic field maintaining developer material on the edge-region of the developer carrying member to form a barrier which inhibits toner emissions from the mid-region into the atmosphere exterior to the housing.

* * * * *